United States Patent [19]

Rhodes et al.

[11] Patent Number: 4,468,314

[45] Date of Patent: Aug. 28, 1984

[54] HYDROPYROLYSIS OF CARBONACEOUS MATERIAL

[75] Inventors: Richard P. Rhodes, Westfield; Kenneth D. Rose, Somerset, both of N.J.

[73] Assignee: Exxon Research and Engineering Co., Florham Park, N.J.

[21] Appl. No.: 413,832

[22] Filed: Sep. 1, 1982

[51] Int. Cl.[3] ..... C10G 1/00; C10B 49/04; C10B 49/10

[52] U.S. Cl. ..... 208/8 R; 208/11 R

[58] Field of Search ..... 208/8 R, 11 R, 107; 48/197 R

[56] References Cited

U.S. PATENT DOCUMENTS

| | | | |
|---|---|---|---|
| 1,814,436 | 7/1931 | Trent | 48/202 |
| 2,435,746 | 2/1948 | Jones | 201/29 |
| 2,694,035 | 11/1954 | Smith et al. | 208/11 R |
| 3,011,953 | 12/1961 | Foch | 208/8 R |
| 3,107,985 | 10/1963 | Huntington | 208/8 R |
| 3,247,092 | 4/1966 | Huntington | 208/8 R |
| 3,421,868 | 1/1969 | Feldmann | 48/197 R |
| 3,736,247 | 5/1973 | Jones et al. | 201/36 X |
| 3,922,215 | 11/1975 | Linden et al. | 48/197 R X |
| 3,944,480 | 3/1976 | Schroeder | 208/8 R X |
| 3,963,598 | 6/1976 | Manowitz et al. | 208/8 R |
| 3,972,801 | 8/1976 | Gregoli | 208/11 R |
| 4,003,820 | 1/1977 | Pelofsky et al. | 208/8 R |
| 4,013,543 | 3/1977 | Greene | 208/8 R X |
| 4,048,053 | 9/1977 | Greene | 208/8 R |
| 4,125,437 | 11/1978 | Bacon | 201/44 |
| 4,133,741 | 1/1979 | Weichman et al. | 208/11 R |
| 4,193,862 | 3/1980 | Ban et al. | 48/197 R X |
| 4,211,632 | 7/1980 | Chukhanov et al. | 208/8 R |
| 4,405,438 | 9/1983 | Faulkner et al. | 208/11 R |

*Primary Examiner*—Delbert E. Gantz
*Assistant Examiner*—Glenn A. Caldarola
*Attorney, Agent, or Firm*—Henry E. Naylor

[57] ABSTRACT

Disclosed is a process for converting solid carbonaceous material, such as coal and oil-shale, to a discriminate range of liquid and gaseous products, which process comprises treating the carbonaceous material with a hydrogen-containing gas at short gas and long solids residence times in two or more temperature zones.

6 Claims, 1 Drawing Figure

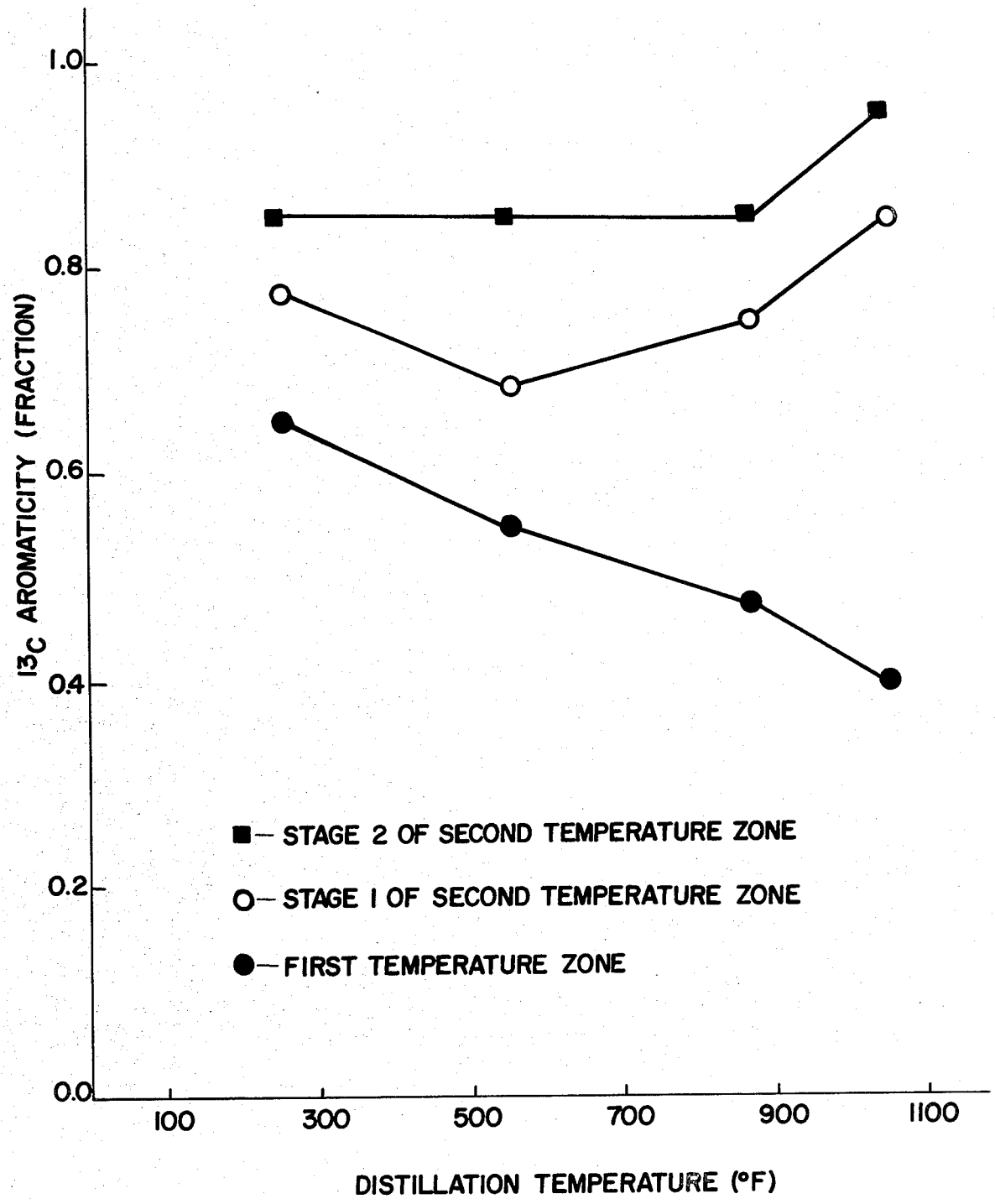
1.0
0.8
0.6
0.4
0.2
0.0
$^{13}C$ AROMATICITY (FRACTION)
100
300
500
700
900
1100
DISTILLATION TEMPERATURE (°F)
■— STAGE 2 OF SECOND TEMPERATURE ZONE
○— STAGE 1 OF SECOND TEMPERATURE ZONE
●— FIRST TEMPERATURE ZONE

HYDROPYROLYSIS OF CARBONACEOUS MATERIAL

The present invention relates to an improved process for the pyrolysis of carbonaceous materials, such as coal and oil-shale, to produce select pyrolytic products.

Coal, once the leading source of energy in the United States, is beginning to play a more important role in the nation's energy future. The primary reason for the growing importance of coal is the rapid depletion of known petroleum and natural gas reserves. As the era of petroleum growth draws to a close, the world's commercial energy mix will have to change. Transition energy sources will be needed as a bridge between petroleum and the potentially unlimited energy sources of the future, such as solar power and nuclear fusion. Owing to their great abundance, coal and oil-shale are perceived as the keystones of such a bridge. Consequently, much work is presently being done to provide economical ways of converting these resources to valuable liquid and gaseous products. Coal liquefaction and pyrolysis processes in which coal, with or without a diluent, is subjected to elevated temperatures and pressures to convert solid coal to normally liquid carbonous products are well known.

Pyrolysis of coal to yield liquids and char is an area of technology which has the potential of leading the way to a successful national synfuels program. Although various pyrolysis processes have met with a limited amount of success, there is still a need in the art for a process for pyrolyzing carbonaceous materials such as coal and oil-shale in which excessive amounts of hydrogen-containing gases are not required, dust problems are virtually eliminated, and the collection of liquids is improved and simplified.

By practice of the present invention, carbonaceous materials such as coal and oil-shale may be pyrolyzed to obtain relatively high liquid yields while substantially eliminating the aforementioned problems which are generally encountered in the practice of conventional pyrolysis processes.

SUMMARY OF THE INVENTION

In accordance with the present invention, there is provided a process for converting solid carbonaceous materials, selected from the group consisting of coal, oil-shale, lignite, and peat, to a discriminated range of liquid and gaseous products, which process comprises:

(a) feeding the carbonaceous material into a plug-flow type reactor, wherein the reactor contains two or more temperature zones with each temperature zone containing one or more stages;

(b) introducing, a hydrogen-containing gas independently, into each stage of each temperature zone in such a manner that the gas residence time in each stage is less than about 30 seconds, wherein the temperature of the hydrogen-containing gas introduced into each successive temperature zone is at a temperature which will cause each successive temperature zone to be at least about 25° C. higher than the preceding temperature zone and wherein the temperature of the gas introduced into the first temperature zone is such that the temperature in that zone is in the range of about 350° C. to about 450° C. and the temperature of the last temperature zone is no greater than about 700° C.; and (c) collecting the liquids and gases from each stage of each temperature zone.

In preferred embodiments of the present invention, the carbonaceous material is coal or oil-shale and the temperature in the first temperature zone is about 400° C.

BRIEF DESCRIPTION OF THE FIGURE

The sole FIGURE is a plot of carbon aromaticity, expressed as a percentage of total carbon atoms, versus distillation temperature for a subbituminous coal pyrolyzed in accordance with the present invention in two temperature zones.

DETAILED DESCRIPTION OF THE INVENTION

Any type of coal or oil-shale may be treated according to the present invention. If coal is treated, it is preferred that the coal be a lower rank coal such as subbituminous coal, lignite, or peat. Of course, other similar solid carbonaceous materials may also be employed. Such lower rank coals usually have the following characteristics: carbon content ranging from about 55 wt.% to 88 wt.%, hydrogen content ranging from about 3.8 wt.% to 6.2 wt.% oxygen content ranging from about 2.6 wt. % to 33 wt.% (MAF basis), and a H/C ratio from about 0.3 to 1.1.

It is preferred that the carbonaceous material have as high a surface area as possible; However, it is not economically justifiable to pulverize the carbonaceous material to a very fine powder. Consequently, it is desirable to expose as much of the carbonaceous material's surface as possible without losing material as dust or fines, or as the economics of grinding or process equipment may dictate. Generally, for purposes of the present invention, the carbonaceous material will be ground to be a finely divided state and will contain a majority of particles less than about 4 mesh, U.S. Sieve Size. The carbonaceous material may be dried by conventional drying techniques, for example, heating to a temperature of about 100° C. to about 110° C.

The carbonaceous material, after grinding, is introduced into a plug flow reactor. The term "plug flow reactor", as used herein, means a reactor of such design that substantially all of the solid material introduced through the top of the reactor exits from the bottom of the reactor in a time period given by the volume of the reactor divided by the volumetric flow rate. There are various ways to achieve plug flow. One way would be to employ a moving bed reactor of vertical design wherein the carbonaceous material is gravity fed at the top of the reactor and flowed downward through two or more temperature zones containing one or more stages before exiting from the bottom. The bottom of the reactor is constructed so that its circumference or opening, is less than the circumference or opening, of the main body of the reactor. Preferably, the bottom of the reactor is of an inverse conical shape wherein the flow thru is controlled by a rotating plug with pockets in its surface which can be adjusted to restrict the flow of material, by varying plug rotation speed, to a desired degree. Hydrogen-containing gas is introduced independently and transverse to the flow of carbonous materials in this type reactor.

Another way of achieving plug flow in a reactor is by using a series of well stirred reactors—such as fluid bed reactors. The fluid beds would be connected in series so that the solid material from one bed would flow downward into the next bed, etc. Each stage of each temperature zone would then be comprised of at least two fluid beds, in series. To more nearly approximate a plug flow reactor, three or four fluid beds in series would be required for each stage. The reaction products from each stage would be collected and kept separate so that chemically distinct products could be obtained from each stage. These reaction products can then be routed to processing and end use.

In either of the above described plug flow schemes, hydrogen-containing gas is independently introduced and passed through the temperature zones of the reactor at temperatures ranging from about 350° C. to about 700° C. such that the gas introduced into each successive temperature zone is at least 25° C. greater than that of the preceeding zone and the temperature of the gas entering the first temperature zone is about 350° C. to about 450° C. Each temperature zone is comprised of one or more stages wherein hydrogen-containing gas is introduced independently into each stage and reaction products may be independently collected from each stage. Of course, all stages in any given temperature zone will be at substantially the same temperature.

The number of temperature zones and stages in any given zone which is selected for the practice of the present invention is primarily a function of the number and quantity of distinct reaction products one wishes to collect during pyrolysis of the carbonaceous material. Furthermore, the temperature of the hydrogen-containing gas introduced into each temperature zone will primarily be a function of the type reaction product(s) one wishes to obtain from that zone as well as a function of the temperature of any preceeding zone.

As is evident from the above, by the judicious selection of: hydrogen partial pressures, temperatures of the temperature zones, number of temperature zones and stages therein; and gas and solids residence times, one is able to obtain relatively high liquid yields and a discriminate selection of reaction products from the pyrolysis of carbonaceous material, such as coal and oil-shale.

In general, the process of the present invention comprises a staged pyrolysis process having a predetermined number of stages wherein pyrolysis occurs over a temperature range of about 350° C. to about 700° C., preferably from temperatures ranging from 400° C. to 600° C., when the carbonaceous material is subbituminous coal. The pyrolysis is performed in the presence of a hydrogen donor material or hydrogen, generally at hydrogen partial pressures of about 350 to 2500 psi which is passed through the flow of carbonaceous material in such a way that separate discriminated product streams can be collected. Of course, any excess hydrogen will be recycled to the various reaction zones.

Plug flow type reactors are used in the practice of the present invention because they are capable of achieving both the short gas residence times and the long solids residences time required herein. In the practice of the present invention the gas residence times for each stage will be less than about 30 seconds, preferably less than about 10 seconds. Solids residence time overall will be from about 5 minutes to about 150 minutes, preferably from about 10 to 50 minutes. By choosing the proper residence times, substantially maximum conversion of carbonaceous material to liquids and gases is achieved and undesirable secondary reactions are minimized.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrative purposes.

EXAMPLE 1

Rawhide sub-bituminous coal ground to 20/80 mesh, U.S. Sieve Size, and dried to less than 1% moisture content, was fed at a rate of 1.18 kilograms per hour into a dense-bed plug flow reactor having two temperature zones. The first temperature zone contained one stage and the second temperature zone contained two stages. Each temperature zone was capable of receiving an independent flow of hydrogen at elevated temperatures and was capable of independent removal of reaction products. The reactor was designed so that it was capable of achieving relatively short gas and long solids residence times.

Hydrogen gas, at an overall rate of 3.44 standard cubic feed per minute was divided into three equal streams wherein one stream was fed into the first temperature zone at 450° C., and the other two were fed independently into each stage of the second temperature zone at a temperature of 585° C. The total pressure in the reactor was 385 psi.

By separately collecting the reaction products from each stage product upgrading and ultimate product disposition is optimized.

Total oil yield from both zones was found to be 22.4 wt.% on dry coal. The distribution of oil product among the stages of the two zones was as follows:

Temperature Zone 1—19.3 wt.%

Temperature Zone 2—1st stage—69.4 wt.%

Temperature Zone 2–2nd stage—11.3 wt.%

The distribution of oil yield for the temperature zones also takes into account a small amount of material which was not collected at the appropriate zone because of condenser inefficiencies.

Samples of oil from each of the three stages were distilled into three distillable fractions. The fraction of total carbon which was aromatic was determined for each sample by quantitative $^{13}C$ NMR spectroscopy. The carbon aromaticity, expressed as a percentage of total carbon atoms was plotted versus distillation temperature, which plot is illustrated herein by the sole FIGURE.

The FIGURE evidences that the product fraction from the first temperature zone becomes more aliphatic with increasing distillation temperature. It was found that most of the long chain normal paraffins are found in the higher boiling cut from this first fraction. The product fraction from the first stage of the second temperature zone contained large amounts of hydroaromatic tetralin-type molecules. The product fraction from the second stage of the second temperature zone was found to contain the more highly condensed aromatic oils. Furthermore, a concentrate of carcinogenic polynuclear aromatics was found in the high boiling product fraction from this second stage. This concentrate can be advantageously disposed of by combustion or gasification. The remainder of the oil will then be relatively free of such contaminants.

The gas residence time in each stage of each temperature zone was approximately 3 seconds. The solids residence time in each stage was about 16 minutes.

EXAMPLE 2

The reactor of Example 1 above was employed except Texas Big Brown lignite of about the same size and moisture as that of the coal of Example 1 was fed into the reactor. The hydrogen feed rate was 2.9 SCFM. The coal feed rate was 1.2 kg/hr.

The hydrogen gas was divided into three equal streams. One stream was fed into the first temperature zone at a temperature of 430° C. and the other two were independently fed into each stage of the second temperature zone at a temperature of about 570° C. Again, as in example 1 above, the second temperature zone was divided into two stages each stage at the same temperature so that the maximum amount of hydroaromatic product could be obtained.

Solids residence time for each stage of each temperature zone was 26 minutes and the gas residence time for each stage was about 3.5 seconds.

Analysis of the product fractions from each reaction zone revealed that the chemical content of the fractions were directionally similar to the fractions obtained in example 1. That is, aliphatic material and waxes were found concentrated in the fraction from the first temperature zone and the more highly aromatics were found to be concentrated in the fraction from second stage of the second temperature zone.

Total oil yield from both zones were found to be 25.8 wt.% on dry coal. The distribution oil product among the stages of the two temperature zones was as follows:

| | $^{13}C$ aromaticity |
|---|---|
| Temperature Zone 1 - 26.8 wt. % | 43.9 |
| Temperature Zone 2 - Stage 1 - 44.7 wt. % | 64.4 |
| Temperature Zone 2 - Stage 2 - 20.5 wt. % | 79.8 |

EXAMPLE 3

Arab Heavy vacuum Residual oil was added to 20/80 mesh attapulgus clay and heated to 100° C. with mild stirring. The oil spread on the clay which served as a carrier to permit feeding into the previously described reactor. The clay carrying the oil was fed into the plug flow reactor at a rate of 1.05/kg/hr. The first temperature zone contained one stage and the second temperature zone contained two stages. Each temperature zone was capable of receiving an independent flow of hydrogen at elevated temperatures and was capable of independent removal of reaction products.

Hydrogen gas at an overall flow rate of 1.52 standard cubic feet per minute was divided into three equal streams wherein one stream was fed into the first temperature zone which was at a temperature of 420° C. The other two hydrogen streams was fed independently into each stage of the second temperature zone which was at a temperature of approximately 580° C. The total pressure in the reactor was 2650 kpa. The total oil yield from both zones was 42 wt. % based on oil fed to the reactor.

The yields and aromaticities of the oils are given in the table below.

| | Yield | $C^{13}$ aromaticity |
|---|---|---|
| Zone 1 | 13.4 | 33 |
| Zone 2 stage 1 | 54.2 | 45 |
| stage 2 | 32.4 | 71 |

The distribution of oil yield for each stage takes into account a small amount of material which was collected in a fourth back-up vessel because of condenser inefficiencies. This material was prorated back to each stage on the assumption that the amount of bypass was proportional to the amount of material collected in the particular stage.

What is claimed is:

1. A process for converting solid carbonaceous material selected from the group consisting of coal, oil-shale, lignite, peat and heavy oil, to a discriminate range of liquid and gaseous products, which process comprises:

(a) feeding the carbonaceous material into a plug flow type reactor containing two or more temperature zones with each temperature zone containing one or more stages, and wherein the temperature of the carbonaceous material within each temperature zone is substantially constant;

(b) introducing a hydrogen-containing gas independently into each one or more stages of each temperature zone in such a manner that the gas residence time in each stage is less than about 30 seconds and the total solids residence time is from about 5 to 150 minutes, wherein the temperature of the hydrogen-containing gas introduced into each successive temperature zone is at a temperature which will cause each successive temperature zone to be at least 25° C. higher than the preceding temperature zone and wherein the temperature of the gas introduced into the first temperature zone is such that the temperature in that zone is in the range of about 350° C. to about 450° C. and the temperature of the last temperature zone is less than about 700° C.; and (c) collecting the liquids and gases from each temperature zone separately.

2. The process of claim 1 wherein the carbonaceous material is subbituminous coal or oil-shale.

3. The process of claims 1 or 2 wherein the reactor contains 2 temperature zones and the temperature of the first temperature zone is 400° C. and the temperature of the second temperature zone is 550° C.

4. The process of claim 3 wherein the plug flow type reactor is comprised of a series of fluid beds.

5. The process of claim 4 wherein the gas residence time for each stage is less than about 10 seconds and the overall solids residence time is from about 10 to 50 minutes.

6. A process for converting subbituminous coal to a discriminate range of liquid and gaseous products, which process comprises:

(a) feeding the subbituminous coal into a plug flow moving bed reactor containing two or more temperature zones with each temperature zone containing one or more stages wherein the temperature of the subbituminous coal within each temperature zone is substantially constant;

(b) introducing, transverse to the flow of subbituminous coal and independently to each one or more stages, a gas having a hydrogen partial pressure of about 350 to 2500 psi, wherein the temperature of the gas introduced to the first temperature zone is such that the temperature of said first zone is from about 350° C. to about 450° C. and the temperature of the gas introduced into each successive temperature zone is such that each successive temperature zone is at least 25° C. greater than that of the immediately preceding temperature zone and wherein the temperature of the last temperature zone is less than about 700° C. and wherein the gas residence time for each stage is less than about 10 seconds and the overall solids residence time is from about 10 to 50 minutes; and (c) collecting the liquids and gases from each temperature zone separately.

* * * * *